US011376471B2

(12) United States Patent
Yamaguchi

(10) Patent No.: US 11,376,471 B2
(45) Date of Patent: Jul. 5, 2022

(54) BALANCE TRAINING APPARATUS AND CONTROL PROGRAM OF BALANCE TRAINING APPARATUS

(71) Applicant: Toyota Jidosha Kabushiki Kaisha, Toyota (JP)

(72) Inventor: Yuhei Yamaguchi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 347 days.

(21) Appl. No.: 16/806,474

(22) Filed: Mar. 2, 2020

(65) Prior Publication Data

US 2020/0289893 A1 Sep. 17, 2020

(30) Foreign Application Priority Data

Mar. 15, 2019 (JP) ..... JP2019-047890

(51) Int. Cl.
*A61H 1/00* (2006.01)
*A63B 26/00* (2006.01)
(Continued)

(52) U.S. Cl.
CPC ..... *A63B 26/003* (2013.01); *A61H 1/001* (2013.01); *A61H 1/005* (2013.01);
(Continued)

(58) Field of Classification Search
CPC ..... A63B 26/003; A63B 24/0087; A63B 71/0622; A63B 2024/0068; A63B 2071/0694; A63B 2208/0204; A63B 2220/56; A63B 2220/807; A63B 2220/833; A63B 2220/836; A63B 71/0054; A63B 2024/0096; A63B 2071/025; A63B 2071/0683; A63B 2220/05; A63B 2220/24; A63B 2220/52; A63B 2225/50; A63B 2230/06; A63B 2230/40; A61H 1/001;
(Continued)

(56) References Cited

U.S. PATENT DOCUMENTS 9,149,222 B1 * 10/2015 Zets ..... A61B 5/4023
9,526,946 B1 * 12/2016 Zets ..... A61B 5/4023
(Continued)

FOREIGN PATENT DOCUMENTS

JP 2015-100477 A 6/2015
JP 2018-121911 A 8/2018
JP 2019-024579 A 2/2019

*Primary Examiner* — Sundhara M Ganesan
(74) *Attorney, Agent, or Firm* — Dinsmore & Shohl LLP

(57) ABSTRACT

The balance training apparatus includes: a moving cart capable of moving on a moving surface by driving a driving unit; a movement controller configured to drive the driving unit and to move the moving cart in accordance with a predetermined swing pattern; a posture detection sensor that is provided in the moving cart and is configured to detect that disturbance of the state of a trainee who is standing on the moving cart has become outside of a predetermined range; and a difficulty level setting unit configured to instruct the movement controller to change the swing pattern and change the difficulty level of the training that moves the moving cart based on results of detecting the state of the trainee regarding which a notification is sent from the posture detection sensor.

7 Claims, 12 Drawing Sheets

(51) Int. Cl.
*A63B 24/00* (2006.01)
*A63B 71/06* (2006.01)

(52) U.S. Cl.
CPC .. *A63B 24/0087* (2013.01); *A61H 2201/1635* (2013.01); *A61H 2201/1669* (2013.01); *A61H 2203/0406* (2013.01); *A61H 2230/625* (2013.01); *A63B 71/0622* (2013.01); *A63B 2024/0068* (2013.01); *A63B 2071/0694* (2013.01); *A63B 2208/0204* (2013.01); *A63B 2220/56* (2013.01); *A63B 2220/807* (2013.01); *A63B 2220/833* (2013.01); *A63B 2220/836* (2013.01)

(58) Field of Classification Search
CPC ..... A61H 1/005; A61H 2201/1635; A61H 2201/1669; A61H 2203/0406; A61H 2230/625; A61H 1/00
See application file for complete search history.

(56) References Cited

U.S. PATENT DOCUMENTS 10,117,602 B1 * 11/2018 Berme ..... A61B 5/1128
2009/0240172 A1 * 9/2009 Fernandez Tournier ..... A63B 26/003 600/595
2011/0312473 A1 * 12/2011 Chu ..... A63B 22/0292 482/54
2012/0094814 A1 * 4/2012 Atkins ..... A61B 5/1036 482/142
2015/0328497 A1 * 11/2015 Doucot ..... A63B 24/0062 482/146
2015/0343266 A1 * 12/2015 Vardy ..... A63B 26/003 482/8
2016/0228746 A1 * 8/2016 Jayakumar ..... A63B 71/0054
2016/0346156 A1 * 12/2016 Walsh ..... A61H 3/008
2017/0189259 A1 * 7/2017 Song ..... A61F 4/00
2018/0289579 A1 * 10/2018 Agrawal ..... A61B 5/112

* cited by examiner

| DIFFICULTY LEVEL | A | T1 | T2 |
|---|---|---|---|
| 1 | 3 | 5 | 10 |
| 2 | 6 | 4.5 | 9 |
| 3 | 9 | 4 | 8 |
| 4 | 12 | 3.5 | 7 |
| 5 | 15 | 3 | 6 |

BALANCE TRAINING APPARATUS AND CONTROL PROGRAM OF BALANCE TRAINING APPARATUS

CROSS REFERENCE TO RELATED APPLICATIONS

This application is based upon and claims the benefit of priority from Japanese patent application No. 2019-047890, filed on Mar. 15, 2019, the disclosure of which is incorporated herein in its entirety by reference.

BACKGROUND

The present disclosure relates to a balance training apparatus and a control program of a balance training apparatus.

Training apparatuses for enabling patients who have disabilities in their legs to perform rehabilitation training have become more and more widespread. For example, a training apparatus in which a trainee who performs training stands on a footplate, the centroid position of the trainee is observed, and the footplate is moved by driving means in order to encourage the trainee to step forward and to prevent the trainee from falling has been known (sec, for example, Japanese Unexamined Patent Application Publication No. 2015-100477).

SUMMARY

In a configuration in which the footplate is moved by a small amount with respect to the training apparatus, the trainee basically maintains an upright state with respect to the floor surface. In this configuration, since there is hardly any environmental change, it is difficult for the trainee to maintain his/her motivation for the training. On the other hand, if a game-like feature is, for example, given to the trial of the training, the trainee will try to perform the trial of the training with a higher motivation as the trainee has a greater physical experience in conjunction with a game. It has been revealed that a configuration in which a balance training apparatus is provided with a moving cart and the whole balance training apparatus on which the trainee rides is moved is effective for rehabilitation training.

In the aforementioned balance training apparatus, however, it is required to adjust, for example, the difficulty level of the training such as the acceleration, the moving speed and the like of the cart in accordance with the degree of recovery of the trainee. In particular, since the degree of recovery of the trainee and the progress speed of the training vary depending on the age, physical strength and the like of the trainee, the difficulty level of the training needs to be finely set for each trainee.

The present disclosure has been made in order to solve the aforementioned problem, and provides a balance training apparatus and the like in which it is possible to adjust the difficulty level depending on the trainee who Has a disability in his/her balance functions when he/she performs rehabilitation training.

A balance training apparatus according to a first aspect of the present disclosure includes: a moving cart capable of moving on a moving surface by driving a driving unit; a movement controller configured to drive the driving unit and to move the moving cart in accordance with a predetermined swing pattern; a posture detection sensor configured to detect that disturbance of a state of a trainee who is standing on the moving cart has become outside of a predetermined range; and a difficulty level setting unit configured to instruct the movement controller to change the swing pattern and change the difficulty level of the training that moves the moving cart based on results of detecting the state of the trainee regarding which a notification is sent from the posture detection sensor.

As described above, by detecting the magnitude of the disturbance of the posture of the trainee by the training and changing the difficulty level of the training, training suitable for the trainee can be provided for the trainee.

The aforementioned posture detection sensor may include at least one of a handrail sensor provided in a handrail attached to the moving cart, a pressure sensor that is provided between the handrail and a strut that supports the handrail, a biological sensor that is attached to a part of the body of the trainee and detects biological information of the trainee, and a camera that is attached to the moving cart and captures an image of the posture of the trainee.

Further, the aforementioned difficulty level setting unit may reduce the difficulty level when a duration period of a state during which disturbance of the state of the trainee regarding which a notification is sent front the posture detection sensor has become outside of the predetermined range has exceeded a first specified value.

Further, the aforementioned difficulty level setting unit may instruct the movement controller to stop the training when the duration period of a state during which disturbance of the state of the trainee regarding which a notification is sent from the posture detection sensor has become outside of the predetermined range has exceeded a third specified value that is larger than the first specified value.

Further, the aforementioned difficulty level setting unit may reduce the difficulty level when an integrated value of a time period of a state during which disturbance of the state of the trainee regarding which a notification is sent from the posture detection sensor has become outside of the predetermined range has exceeded a predetermined rate in a determination threshold period having a predetermined length.

Further, the aforementioned difficulty level setting unit may increase the difficulty level when a duration period of a state during which the disturbance of the state of the trainee regarding which a notification is sent from the posture detection sensor is within the predetermined range has become equal to or larger than a difficulty level increase determination period set based on a second specified value.

Further, a control program of a balance control apparatus according to a second aspect is a control program of a balance training apparatus in which a trainee standing on u moving cart that moves on a moving surface performs balance training, the control program causing a computer to execute the following steps of: a movement control step for driving a driving unit that moves the moving cart to move the moving cart in accordance with a predetermined swing pattern; a posture detection step for detecting that disturbance of the state of the trainee has become outside of a predetermined range; and a difficulty level setting step for changing the swing pattern and changing the difficulty level of the training that moves the moving cart based on results of detecting the state of the trainee regarding which a notification is sent in the posture detection step. According to the balance training apparatus controlled by the aforementioned control program, by detecting the magnitude of the disturbance of the posture of the trainee by the training and changing the difficulty level of the training, it is possible to provide training suitable for the trainee for the trainee.

According to the present disclosure, it is possible to provide training at a difficulty level in accordance with the physical ability of the trainee who has a disability in his/her balance functions when he/she performs rehabilitation training.

The above and other objects, features and advantages of the present disclosure will become more fully understood from the detailed description given hereinbelow and the accompanying drawings which are given by way of illustration only, and thus are not to be considered as limiting the present disclosure.

DETAILED DESCRIPTION

Hereinafter, the present disclosure will be explained with reference to embodiments of the present disclosure. However, the disclosure set forth in the claims is not limited to the following embodiments. Further, not ail the structures explained in the embodiments may be necessary as means for solving the problem. Further, in the following description, components that are common in a plurality of embodiments are explained in the description of one embodiment, and the descriptions thereof will be omitted in other embodiments.

First Embodiment

Figure 1:
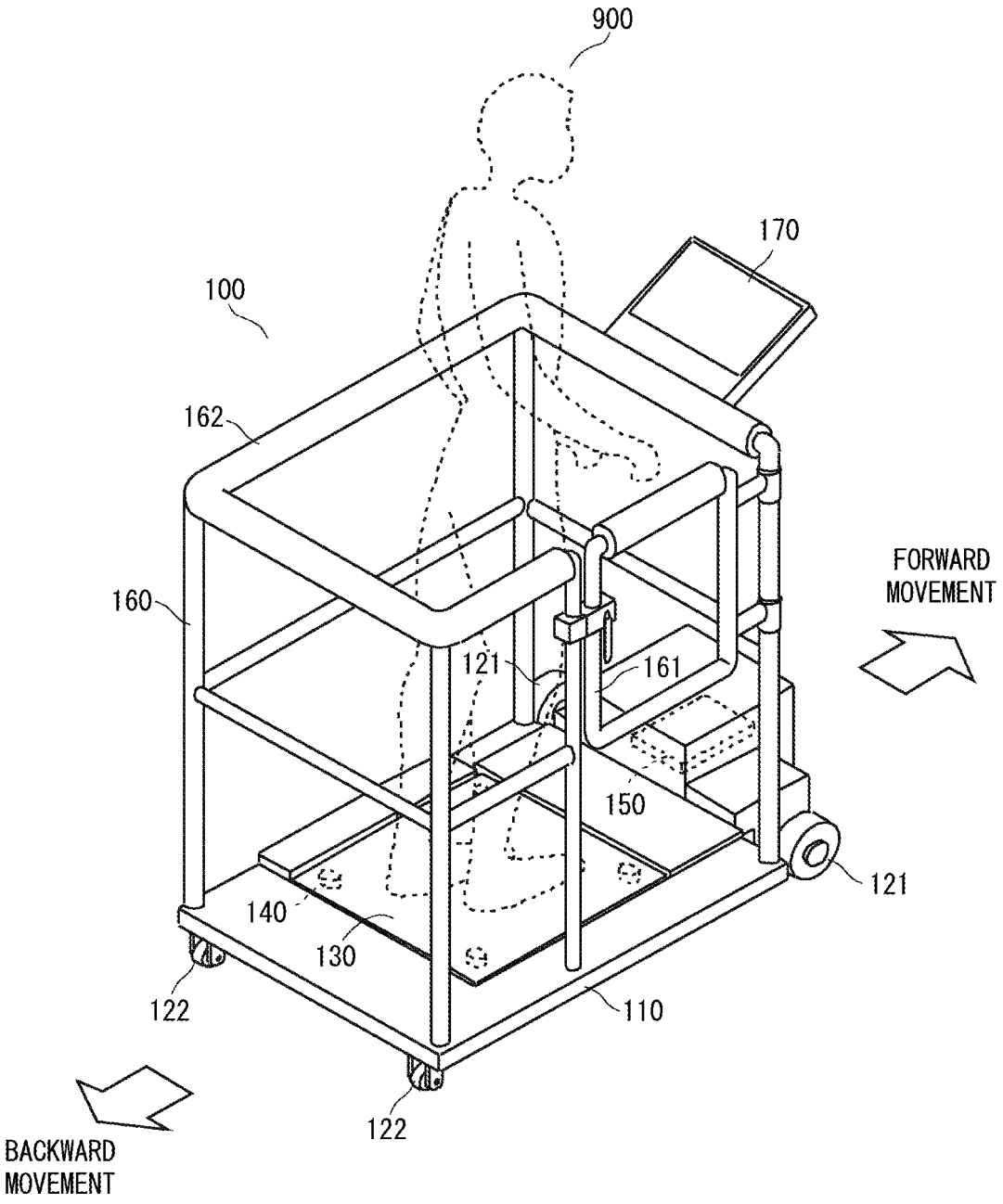
FIG. 1 is a schematic perspective view of a training apparatus according to a first embodiment.

FIG. 1 is a schematic perspective view of a training apparatus 100, which is one example of a balance training apparatus according to a first embodiment. The training apparatus 100 is an apparatus for enabling a disabled person having a disability such as hemiplegia to learn a centroid movement that is necessary for walking or enabling a patient who has a disability in his/her ankle joint to recover an ankle joint function. When, for example, a trainee 900 who desires to recover the ankle joint function continues to ride the training apparatus 100 while balancing himself/herself, the training apparatus 100 is able to give the ankle joint of the trainee 900 a load that can be expected to achieve rehabilitation effects.

The training apparatus 100 includes a moving cart 110 that can move on a moving surface, which is a floor surface or the like of a rehabilitation facility, in the front/back direction, and a frame 160 that is installed in the moving cart 110 and prevents the trainee 900 who rides the moving cart 110 from falling off. The moving cart 110 mainly includes driving wheels 121, casters 122, a riding plate 130, load sensors 140, and a control box 150.

The driving wheels 121 are provided as two front wheels with respect to the traveling direction. The driving wheels 121, which are rotationally driven by a motor (not shown) provided as a driving unit, move the moving cart 110 forward or backward. The casters 122, which are trailing wheels, are provided as two rear wheels with respect to the traveling direction. The riding plate 130 is a riding part where the trainee 900 rides and puts his/her feet. The riding plate 130 is a flat plate made of, for example, polycarbonate resin having a relatively high rigidity that can withstand riding of the trainee 900. The riding plate 130 is supported on the upper surface of the moving cart 110 via the load sensors 140 arranged at four corners of the riding plate 130.

The load sensors 140. which are, for example, load cells, function as detection units configured to detect loads received from the feet of the trainee 900 who is standing on the moving cart 110. The control box 150 accommodates an operation processing unit and a memory that will be described later.

The frame 160 includes an opening door 161 and a handrail 162. The opening door 161 is opened when the trainee 900 rides the riding plate 130 and forms a passage where the trainee 900 passes. When the trial of the training is performed, the opening door 161 is closed and locked. The handrail 162 is provided so as to surround the trainee 900 so that the trainee 900 is able to hold the handrail 162 when he/she is about to lose his/her balance or when he/she feels unsafe. The frame 160 supports a display panel 170. The display panel 170, which is, for example, a display unit such as a liquid crystal panel, is provided in a position where the trainee 900 can easily see it during the trial of the training.

Figure 2:
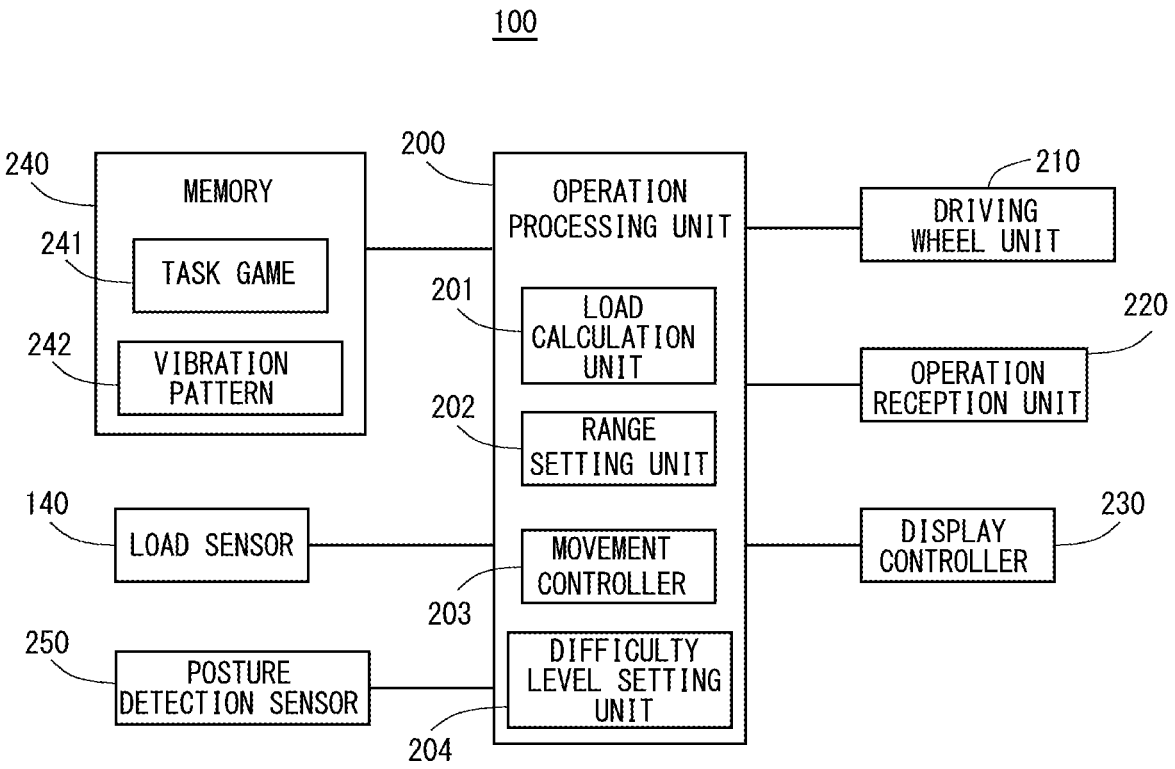
FIG. 2 is a diagram showing a system configuration of the training apparatus according to the first embodiment.

FIG. 2 is a diagram showing a system configuration of the training apparatus 100. An operation processing unit 200, which is. for example, an MPU, executes a control program loaded from a memory 240, thereby executing control of the entire apparatus. A driving unit (e.g., a driving wheel unit 210) includes a driving circuit and a motor for driving the driving wheel(c) 121. Further, the driving wheel unit 210 includes a rotary encoder configured to detect the rotation amount of the driving wheels 121.

An operation reception unit 220 accepts an input operation from the trainee 900 or an operator and transmits an operation signal to the operation processing unit 200. The trainee 900 or the operator operates an operation button provided in the apparatus, a touch panel overlapped with the display panel 170, an attached remote control or the like, thereby turning on/off the power supply, giving an instruction for starting the trial of the training, inputting numerical values regarding setting, or selecting a menu item.

A display controller 230 generates, for example, an instruction regarding the posture to be sent to the trainee 900, a graphic image of a task game or the like in accordance with a display signal from the operation processing unit 200, and displays the generated message or image on the display panel 170. The memory 240, which is a non-volatile storage medium, may be, for example, a solid state drive. The memory 240 stores a control program etc. for controlling the training apparatus 100. The memory 240 further stores parameter values, functions. lookup tables and the like such as a plurality of swing patterns to be used for control. The memory 240 stores, in particular, a task game 241, which is a program for giving a task in a form of a game so as to allow the trainee 900 to enjoy performing the trial of the training, and a swing pattern 242 that defines how to operate the moving cart 110. The load sensor 140 detects a load applied from the foot of the trainee 900 via the riding plate 130 and transmits the detection signal to the operation processing unit 200. A posture detection sensor 250 detects that disturbance of the state of the trainee 900 has become outside of a predetermined range. The posture detection sensor 250 detects disturbance of the posture of the trainee 900 or disturbance of the state of the trainee 900 such as the heart rate in a state in which the posture detection sensor 250 contacts the trainee 900 or does not contact the trainee 900.

The operation processing unit 200, which is a calculation unit, also serves as a function execution unit configured to execute various operations and control of individual elements in accordance with a request from the control program, A load calculation unit 201 acquires the detection signals from the four load sensors 140 and calculates the center of gravity of the loads of the respective feet of the trainee 900 on the riding surface. More specifically, since the respective positions of the four load sensors 140 are known, the centroid position is calculated from the distribution of the loads in the vertical direction detected by the respective load sensors 140, and this position is set as a center of gravity of the loads.

A range setting unit 202 sets a range of stability, which is a range of the center of gravity of the load estimated that the trainee 900 can maintain his/her upright state on the riding surface. A movement controller 203 drives the driving wheel unit 210 based on the movement amount of the center of gravity of the load and moves the moving cart 110 in accordance with a predetermined swing pattern. Further, the movement controller 203 generates a driving signal to be transmitted to the driving wheel unit 210, and controls the movement of the moving cart 110 via the driving wheel unit 210.

A difficulty level setting unit 204 instructs the movement controller 203 to change the swing pattern to change the difficulty level of the training that moves the moving cart 110 based on the results of detecting the state of the trainee 900 regarding which a notification is sent from the posture detection sensor 250. In the first embodiment, the posture detection sensor 250 transmits, when the posture of the trainee 900 shows disturbance whose magnitude is equal to or larger than a predetermined range, the results of the detection to the difficulty level setting unit 204. Then the difficulty level setting unit 204 instructs the movement controller 203 to decrease the difficulty level of the training when the disturbance of the state of the trainee 900 regarding which a notification is sent from the posture detection sensor 250 has continued for a predetermined first threshold or more.

Note that the training apparatus 100 according to the first embodiment also performs active load training which actively moves the moving cart 110 to maintain the posture of the trainee 900, in addition to the training of moving the moving cart 110 in accordance with the movement of the center of gravity of the load of the trainee 900. That is, in the active load training of the training apparatus 100 according to the first embodiment, the functions of the load sensor 140, the load calculation unit 201, and the range setting unit 202 are not actively used. On the other hand, in the active load training of the training apparatus 100 according to the first embodiment, the movement controller 203 gives a driving instruction to the driving wheel unit 210 in accordance with the swing pattern 242 stored in the memory 240 to move the moving cart 110.

Figure 3:
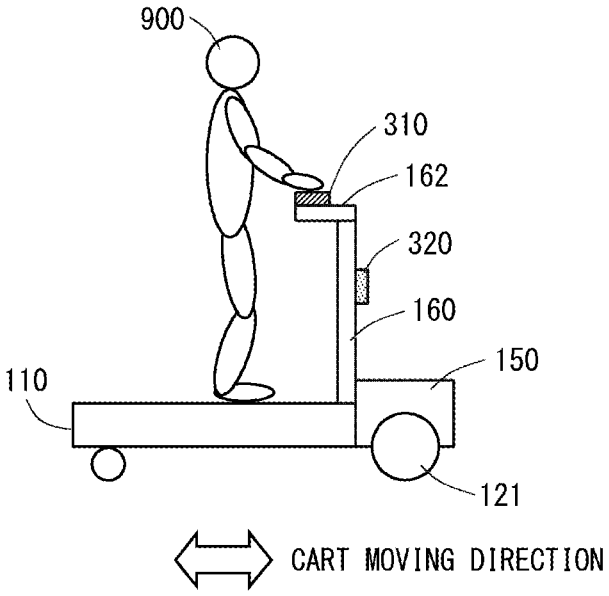
FIG. 3 is a schematic view for describing a function of the training apparatus according to the first embodiment.

Now, a method of adjusting the difficulty level, which is one of the features of the training apparatus 100 according to the first embodiment, and the configuration of the training apparatus 100 will be described in further detail. FIG. 3 shows a schematic view for describing a function of the training apparatus according to the first embodiment. The configuration shown in FIG. 3 is the one that selectively shows configurations that are necessary for adjustment of the difficulty level that will be described below, and the training apparatus 100 according to the first embodiment includes, for example, other configurations shown in FIG. 1. Further, in FIG. 3, descriptions of the configurations the same as those described with reference to FIG. 1 will be omitted.

As shown in FIG. 3, the training apparatus 100 according to the first embodiment is provided with a handrail switch 310 in the handrail 162 attached to a strut (e.g., the frame 160) installed in the moving cart 110. This handrail switch 310 is one of sensors that can be used as the posture detection sensor 250. Further, in the example shown in FIG. 1, the form in which the power supply button that instructs a power supply displayed on the display panel 170 to be turned on/off is attached to the frame 160 as a training switch 320 has been shown. In this way, by providing the training switch 320 in the frame 160, it becomes possible for the operator to easily start or stop operating the training apparatus 100.

Figure 4:
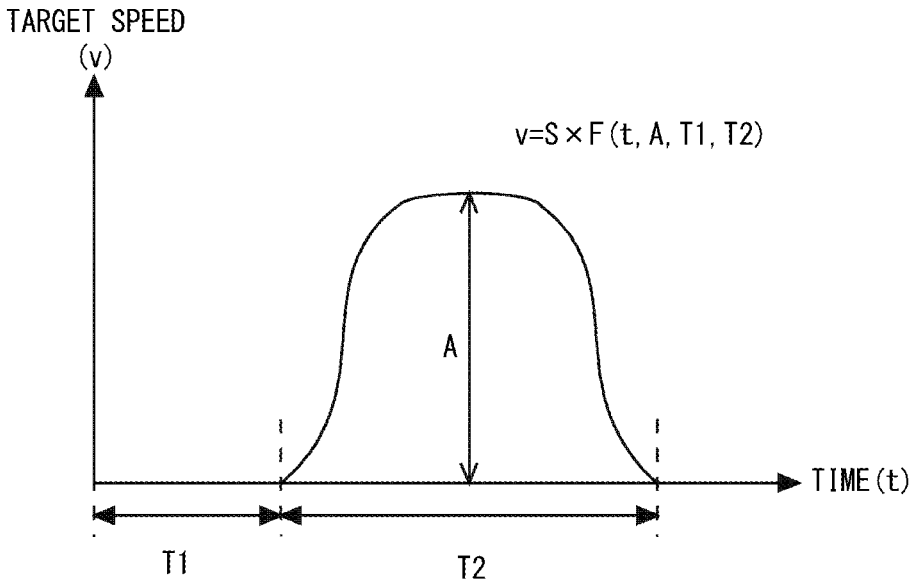
FIG. 4 is a diagram for describing difficulty levels of training of the training apparatus according to the first embodiment.

In the training apparatus 100 according to the first embodiment, the difficulty level of the training is adjusted in accordance with the physical strength and the degree of the recovery of the trainee 900. Therefore, in the training apparatus 100 according to the first embodiment, a plurality of swing patterns of the moving cart 110 are set as the training provided for the trainee 900. The swing pattern 242 stored in the memory 240 includes a plurality of swing patterns. This swing pattern 242 includes a plurality of swing patterns whose difficulty levels are different from one another. FIG. 4 shows one example of the swing pattern 242. FIG. 4 is a diagram for describing difficulty levels of the training of the training apparatus according to the first embodiment. The upper diagram in FIG. 4 shows a graph for describing a change in the speed of the moving cart 110 by the swing pattern and parameters for changing the speed. Further, the lower diagram in FIG. 4 shows a table in which parameters of the swing patterns are listed for each difficulty level.

In the example shown in FIG. 4, the swing pattern according to the first embodiment is indicated by a speed change curve graph expressed by a speed function F using three parameters, that is, a stop period Tl, a swing period T2, and a speed strength parameter A. More specifically, in the example shown in FIG. 4, in the swing pattern according to the first embodiment, when the target speed is denoted by v, a traveling direction parameter that indicates the traveling direction of the moving cart 110 is denoted by S, the time elapsed after the start of the training is denoted by t, the stop period is denoted by T1, the swing period is denoted by T2, and the speed strength parameter is denoted by A, the target speed v can be expressed by Expression (1). It is assumed that the moving cart 110 moves in the forward direction when the traveling direction parameter S in Expression (1) is 1. whereas the training apparatus 100 moves in the backward direction when the traveling direction parameter S is −1.

$$v=S\times F(t,A,T1,T2) \quad (1)$$

Further, in the example shown in the lower diagram of FIG. 4, the swing pattern according to the first embodiment defines the difficulty levels from 1 to 5, in which the difficulty level 5 indicates the highest difficulty level and the difficulty level 1 is the lowest difficulty level. The swing pattern whose difficulty level is the highest moves the moving cart 110 at a high speed within a short period of time. On the other hand, the swing pattern whose difficulty level is low moves the moving cart 110 at a low speed while taking a long period of time.

Figure 5:
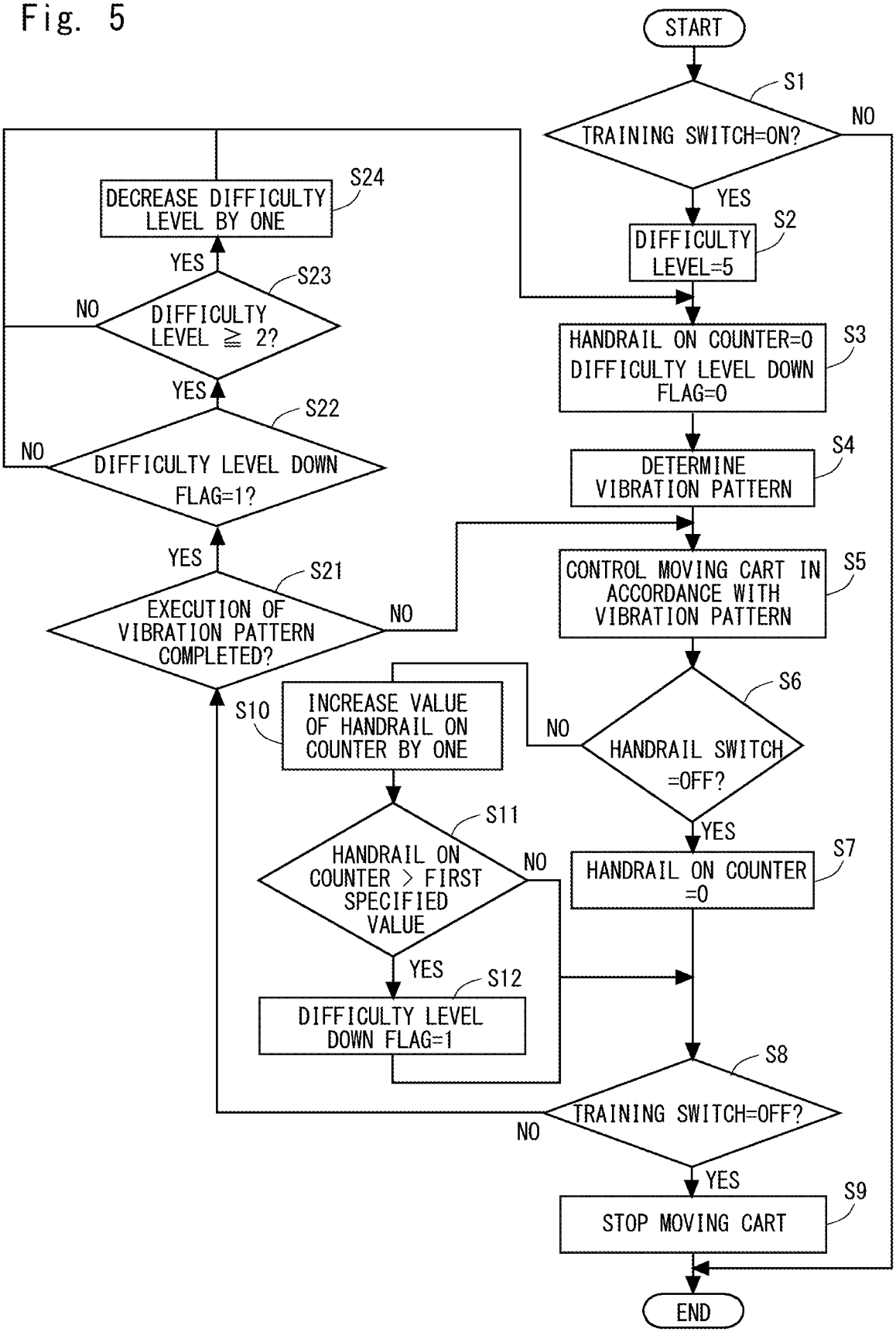
FIG. 5 is a flowchart for describing an operation of the training apparatus according to the first embodiment.

Next, an operation of the training apparatus 100 according to the first embodiment will be explained. FIG. 5 shows a flowchart for describing an operation of the training apparatus according to the first embodiment. While a case in which the lowest difficulty level is set to 1 and the highest difficulty level is set to 5 is shown in the example shown in FIG. 5, the way in which the difficulty level is increased or decreased may be changed as appropriate in accordance with the way of setting the difficulty level.

As shown in FIG. 5, in the training apparatus 100 according to the first embodiment, first, the training switch is turned on, whereby the training is started (Step S1). When the training is started, the difficulty level setting unit 204 sets a difficulty level counter that stores the value that specifies the swing pattern to be 5 (Step S2), Then a handrail ON counter defined in a register or the like in the difficulty level setting unit 204 is set to 0 and a difficulty level down flag is set to 0 (Step S3). After that, the difficulty level setting unit 204 refers to the value of the difficulty level counter and determines the swing pattern (Step S4). Then the training apparatus 100 controls the moving cart 110 in accordance with the swing pattern selected in Step S4 (Step S5).

Next, in the training apparatus 100 according to the first embodiment, when the handrail switch 310 indicates the OFF state, the difficulty level setting unit 204 sets the handrail ON counter to 0 (YES in Step S6). Further, in the training apparatus 100, when the handrail switch 310 indicates the ON state (NO in Step S6), the difficulty level setting unit 204 increases the value of the handrail ON counter by one (Step S10). After that, the difficulty level setting unit 204 determines whether the handrail ON counter exceeds a predetermined first specified value (Step S1). When it is determined in Step S11 that the handrail ON counter is equal to or smaller than the first specified value, the difficulty level setting unit 204 performs the determination in Step S8. On the other hand, when it is determined in Step S11 that the handrail ON counter is larger than the first specified value, after the difficulty level setting unit 204 rewrites the difficulty level down flag to 1, it makes a determination of Step S8 (Step S12). Step S8 is determination regarding whether the training switch has been set to the OFF state. When it is determined in Step S12 that the training switch has been set to the OFF state, the training apparatus 100 stops the operation (Step S9). On the other hand, when it is determined in Step S8 that the training switch is in the ON state, the movement controller 203 of the training apparatus 100 determines whether the swing pattern is being executed at the current timing (Step S21).

When the movement controller 203 has determined in Step S21 that the swing pattern is being executed (NO in Step S21), the movement controller 203 and the difficulty level setting unit 204 execute Steps S5-S8 and Steps S10-S12. On the other hand, when the movement controller 203 has determined in Step S21 that the execution of the swing pattern has been completed (YES in Step S21), the difficulty level setting unit 204 performs processing of adjusting the difficulty level in Steps S22-S24.

In Step S22, the difficulty level setting unit 204 refers to the difficulty level down flag. When the difficulty level down flag is 0, processing is continued again from the processing of Step S3 without changing the difficulty level of the swing pattern. On the other hand, when the difficulty level setting unit 204 has determined in Step S22 that the difficulty level down flag is 1, the difficulty level setting unit 204 determines whether the difficulty level of the swing pattern currently selected by the movement controller 203 is equal to or larger than 2 (Step S22). When the difficulty level is equal to or larger than 2, the difficulty level setting unit 204 updates the difficulty level of the swing pattern selected by the movement controller 203 to a value obtained by reducing one from the current value (Step S23). On the other hand, when it is determined in Step S22 that the difficulty level is smaller than 2, the difficulty level setting unit 204 maintains the difficulty level of the swing pattern selected by the movement controller 203 to be the current value (NO in Step S22) since the difficulty level cannot be further reduced. After the update processing in Step S24 or the difficulty level maintenance determination processing in Step S23 has been completed, the training apparatus 100 continues the processing in series from the processing of Step S3.

Figure 6:
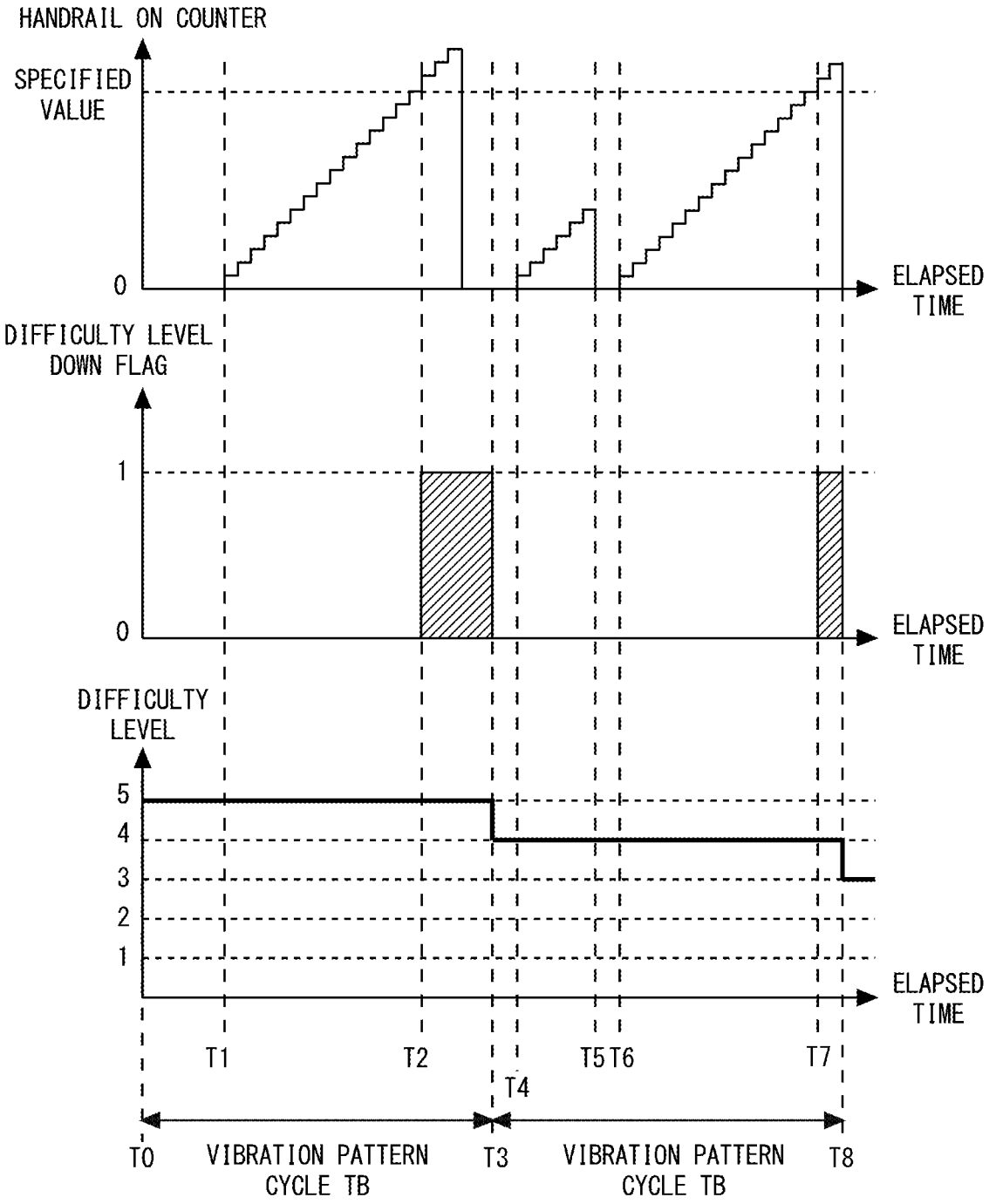
FIG. 6 is a timing chart for describing a change in the difficulty level of the training in the training apparatus according to the first embodiment.

The change in the difficulty level when the operation along the flowchart shown in FIG. 5 is performed will be explained using a timing chart. FIG. 6 shows a liming chart for describing the change in the difficulty level of the training in the training apparatus according to the first embodiment. The example shown in FIG. 6 shows an operation of the training apparatus 100 over a period in which the swing pattern is executed twice. Further, the example shown in FIG. 6 shows an example in which the swing pattern of the difficulty level 5 is selected in the first swing pattern cycle, and then the difficulty level of the swing pattern is lowered to 4 in the next swing pattern cycle since the trainee 900 can no longer maintain his/her posture.

In the example shown in FIG. 6, from timing T0 to timing T3, the first swing pattern cycle TB is executed. In the example shown in FIG. 6. at timing T1, the trainee 900 turns on the handrail switch. It becomes difficult for the trainee 900 to maintain his/her posture when the difficulty level of the training exceeds his/her ability. In this case, the trainee 900 maintains his/her posture by holding the handrail 162 while pushing this handrail switch 310. Then at timing T2, the handrail ON counter exceeds the first specified value. Accordingly, at timing T2, the difficulty level down flag is rewritten from 0 to 1. Then, at a timing later than the timing T2, the trainee 900 releases his/her hand from the handrail switch 310, whereby the handrail ON counter is reset to zero. However, the difficulty level down flag rewritten to 1 at timing T2 maintains 1 until the swing pattern cycle at timing T3 is completed.

Then, at the time of switching of the swing pattern cycle TB at timing T3, the difficulty level setting unit 204 reduces the difficulty level of the swing pattern selected by the movement controller 203 by one since the difficulty level down flag is 1.

Further, in the example shown in FIG. 6, from timing T3 to timing T8, the second swing pattern cycle TB is executed. In the example shown in FIG. 6, at timing T4, the trainee 900 turns on the handrail switch. However, in the second swing pattern cycle TB in which the difficulty level has been reduced, the trainee 900 releases his/her hand from the handrail switch 310 at timing T5. Accordingly, at timing T5, the value of the handrail ON counter is reset to zero. After that, at timing T6, the trainee 900 turns on the handrail switch 310 again. After that, when the state in which the trainee 900 turns on the handrail switch 310 is maintained, the handrail ON counter exceeds the first specified value at timing T7. Therefore, at timing T7, the difficulty level down flag is rewritten from 0 to 1. At a timing later than timing T7, the trainee 900 releases his/her hand from the handrail switch 310, whereby the handrail ON counter is reset to zero. However, the difficulty level down flag rewritten to 1 at timing T7 is maintained to be 1 until the swing pattern cycle at timing T8 is completed.

Then, at the time of switching of the swing pattern cycle TB at timing T8, the difficulty level setting unit 204 reduces the difficulty level of the swing pattern selected by the movement controller 203 by one since the difficulty level down flag is 1.

From the aforementioned description, with the training apparatus 100 according to the first embodiment, in the active load training for actively operating the moving cart 110 in accordance with the swing pattern, the handrail switch 310 is provided in the handrail that the trainee 900 uses as a support to maintain his/her posture when the difficulty level of the training is higher than the ability of the trainee 900. Then the strength of the training is reduced or maintained based on the length of the period of a state during which the ON state of the handrail switch 310 during the training is maintained.

From the above discussion, in the training apparatus 100 according to the first embodiment, when the difficulty level of the training provided for the trainee 900 is high, the difficulty level of the training can be reduced to a difficulty level that matches the ability of the trainee 900. Further, in the training apparatus 100 according to the first embodiment, the difficulty level is gradually reduced starting from the swing pattern whose difficulty level is the highest. Therefore, it becomes possible to enable the trainee 900 to perform training in which the difficulty level that the trainee 900 can deal with in view of his/her ability is maintained to be as high as possible.

Further, since the swing patterns are stored in the memory 240 in advance, the training apparatus 100 according to the first embodiment needs not generate a swing pattern in accordance with the difficulty level of the training by operations. Further, in the training apparatus 100 according to the first embodiment, the handrail switch 310 is provided in the handrail 162, whereby even in a situation in which it is difficult for the trainee 900 to maintain his/her posture, it becomes easy for the trainee 900 to maintain his/her posture while pushing the handrail switch 310.

Second Embodiment

Figure 7:
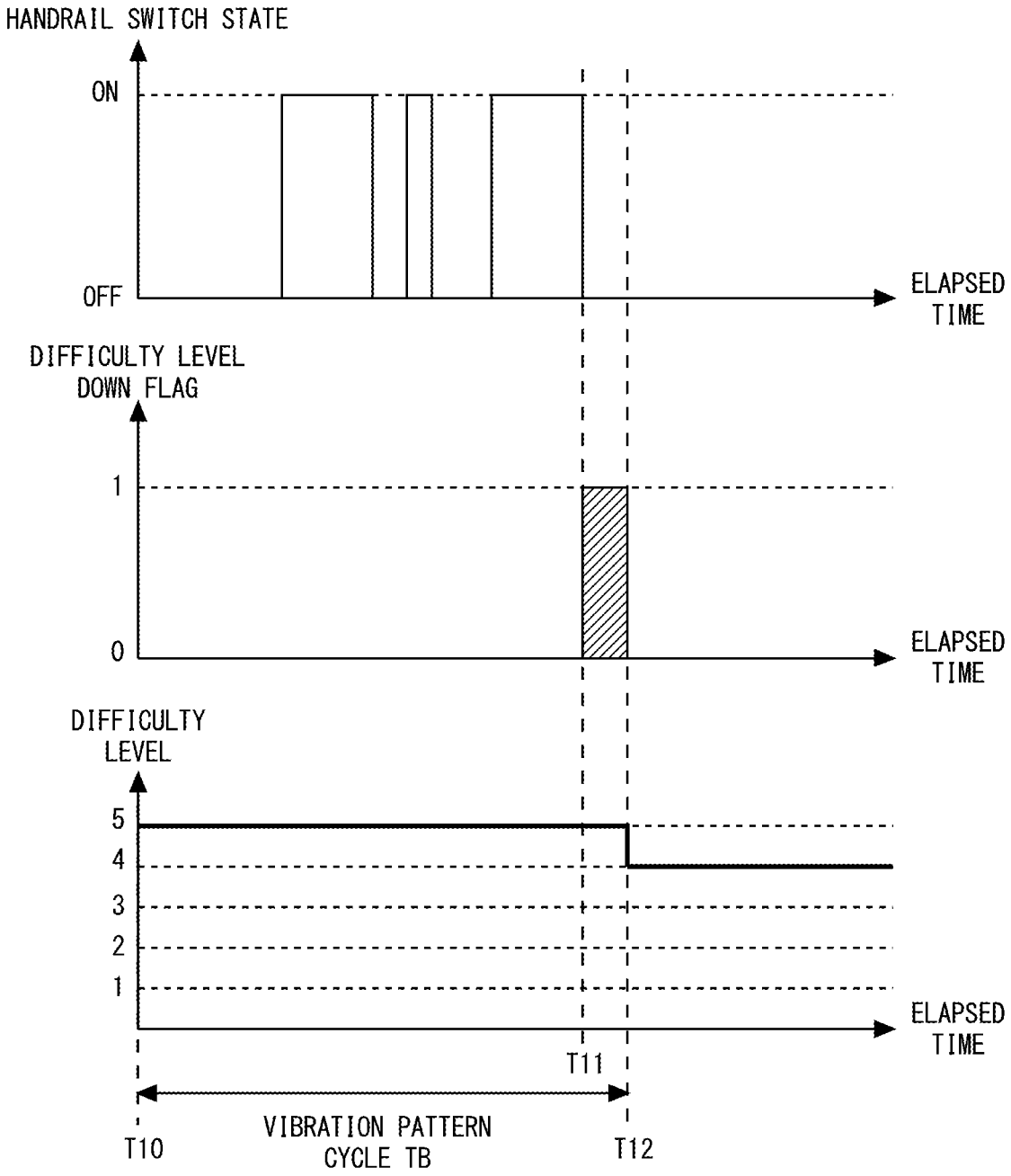
FIG. 7 is a liming chart for describing a change in a difficulty level of training in a training apparatus according to a second embodiment.

In a second embodiment, another method of determining the disturbance of the posture of the trainee 900 for changing the difficulty level of the training will be explained. FIG. 7 shows a timing chart for describing a change in the difficulty level of the training in a training apparatus according to the second embodiment.

In the training apparatus 100 according to the second embodiment, the difficulty level setting unit 204 reduces the difficulty level when an integrated value within a predetermined period of time of the time when the handrail switch 310 is in the ON state becomes equal to or larger than a certain rate with respect to the predetermined period of time. That is, the difficulty level setting unit 204 according to the second embodiment reduces the difficulty level when the integrated value of the time in a state in which the disturbance of the state of the trainee 900 regarding which a notification is sent from the posture detection sensor 250 has become outside a predetermined range exceeds a predetermined rate within a determination threshold period having a predetermined length.

In the example shown in FIG. 7, the length of one swing pattern cycle TB is set as a predetermined period of time (e.g.. determination threshold period). Then, in the example shown in FIG. 7, the handrail switch 310 becomes the ON state intermittently during a period from timing T10 when the swing cycle pattern TB is started to timing T11. The difficulty level setting unit 204 integrates the period of a state during which the handrail switch 310 is in the ON state. At timing T11, the difficulty level down flag is set to 1 since the integrated value has exceeded a predetermined determination threshold. Accordingly, at timing T12 at which the swing pattern is switched to the next cycle, the difficulty level of the swing pattern selected by the movement controller 203 is reduced.

From the aforementioned description, the determination method for determining that it is not appropriate for the trainee 900 to continue training at the current difficulty level in view of the disturbance of the posture of the trainee 900 can be changed, for example, depending on the specification of the training apparatus 100 or the type of the training, not only by the determination method according to the first embodiment shown in FIG. 6. The cases in which the disturbance of the posture that makes the handrail switch 310 be switched intermittently to the ON state as shown in FIG. 7 includes, for example, a case in which the ability of the trainee 900 is slightly lower than the difficulty level of the training. In this case, by employing the determination method according to the second embodiment, it becomes possible to provide training at an appropriate difficulty level for a trainee whose determination regarding whether to switch the difficulty level of the training is difficult as well.

Third Embodiment

Figure 8:
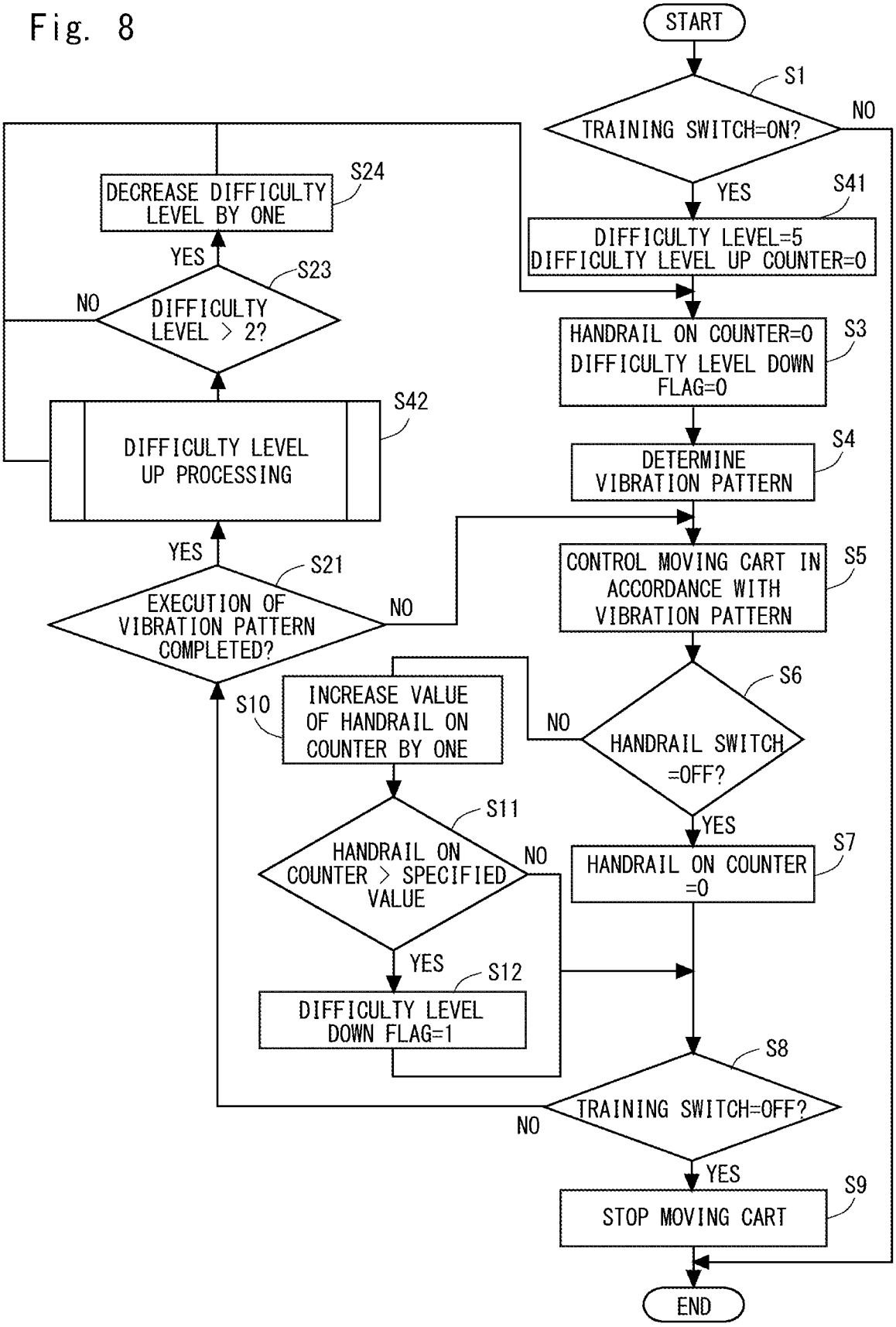
FIG. 8 is a flowchart for describing an operation of a training apparatus according to a third embodiment.

In a third embodiment, an operation method in which processing for increasing the difficulty level of the training is added, besides processing for decreasing the difficulty level of the training, will be explained. FIG. 8 shows a flowchart for describing an operation of a training apparatus 100 according to the third embodiment.

As shown in FIG. 8, in the training apparatus 100 according to the third embodiment. Steps S2 and S22 in the flowchart according to the first embodiment shown in FIG. 5 are replaced by Steps S41 and S42. In Step S41, the initial difficulty level of the training is set, and at the same time the value of the difficulty level up counter newly set in the training apparatus 100 according to the third embodiment is reset to zero. Step S42 is the difficulty level up processing. The difficulty level up processing is processing performed by the difficulty level setting unit 204. In the difficulty level up processing, the difficulty level is increased when the duration period of a slate during which disturbance of the state of the trainee 900 regarding which a notification is sent from the posture detection sensor 250 is within a predetermined range has become equal to or larger than the difficulty level increase determination period set based on the second specified value. The detailed processing of the difficulty level up processing will be described below.

Figure 9:
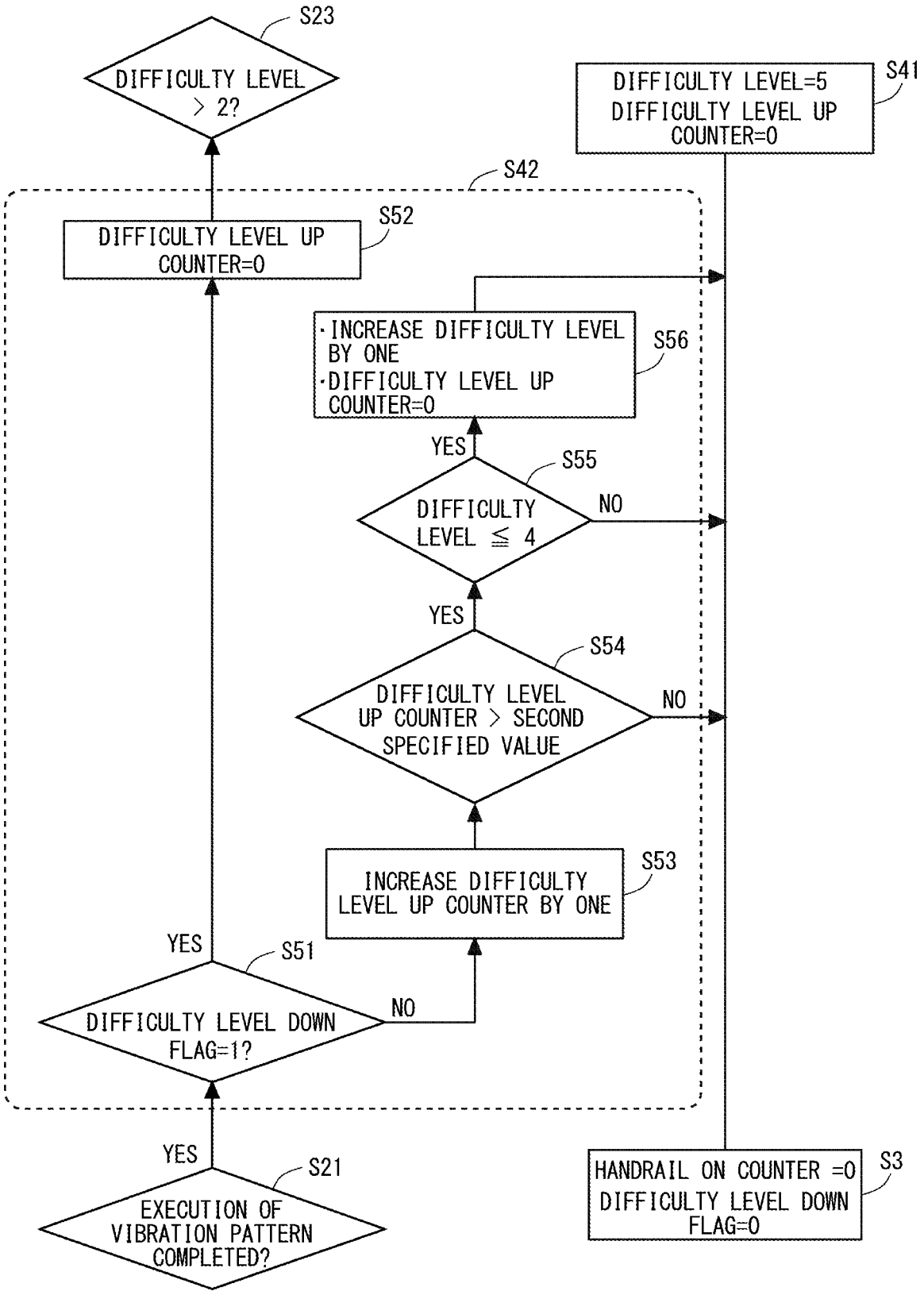
FIG. 9 is a flowchart for describing an operation of difficulty level up processing of the training apparatus according to the third embodiment.

FIG. 9 shows a flowchart for describing an operation of the difficulty level up processing of the training apparatus according to the third embodiment. In FIG. 9, in order to describe the relation between the difficulty level up processing (Step S42) and processing before and after this processing, process steps before and after the difficulty level up processing are described as well.

As shown in FIG. 9, the difficulty level up processing is performed when it is determined in Step S21 that the execution of the swing pattern has been completed. In the difficulty level up processing, it is first determined whether the difficulty level down flag is 1 (Step S51). When it is determined in Step S51 that the difficulty level down flag is 1 (YES in Step S51), the difficulty level setting unit 204 resets the difficulty level up counter to zero and determines the value of the difficulty level shown in Step S23 (Step S52).

On the other hand, when it is determined in Step S51 that the difficulty level down flag is 0 (NO in Step S51), the difficulty level setting unit 204 performs processing of increasing the value of the difficulty level up counter by one (Step SS3). Alter that, the difficulty level setting unit 204 compares the value of the difficulty level up counter with a predetermined second specified value (Step S54). When it is determined in Step S54 that the value of the difficulty level up counter is equal to or smaller than the second specified value (NO in Step S54), the difficulty level setting unit 204 performs the processing of Step S3 as the next processing. On the other hand, when it is determined in Step S54 that the value of the difficulty level up counter is larger than the second specified value (YES in Step S54), the difficulty level setting unit 204 determines whether the current difficulty level is equal to or smaller than 4 (Step S55).

When it is determined in Step S55 that the current difficulty level is larger than 4 (NO in Step S55), the difficulty level setting unit 204 performs the processing of Step S3 as the next processing. On the other hand, when it is determined in Step S55 that the current difficulty level is equal to or smaller than 4 (YES in Step S5S), the difficulty level setting unit 204 increases the current difficulty level by one and resets the difficulty level up counter to zero (Step S56). Then, after the processing of Step S56 is completed, the difficulty level setting unit 204 performs the processing of Step S3 as the next processing.

In the example shown in FIG. 9, the difficulty level increase determination period is determined by (he product of the execution period of one swing pattern cycle and the second specified value.

From the aforementioned description, the training apparatus 100 according to the third embodiment is able to not only decrease the difficulty level of the training but also increase the difficulty level of the training when the trainee 900 has succeeded in the training for a plurality of swing pattern cycles. Accordingly, the training apparatus 100 according to the third embodiment is able to provide training at a more appropriate difficulty level for the trainee 900.

Fourth Embodiment

Figure 10:
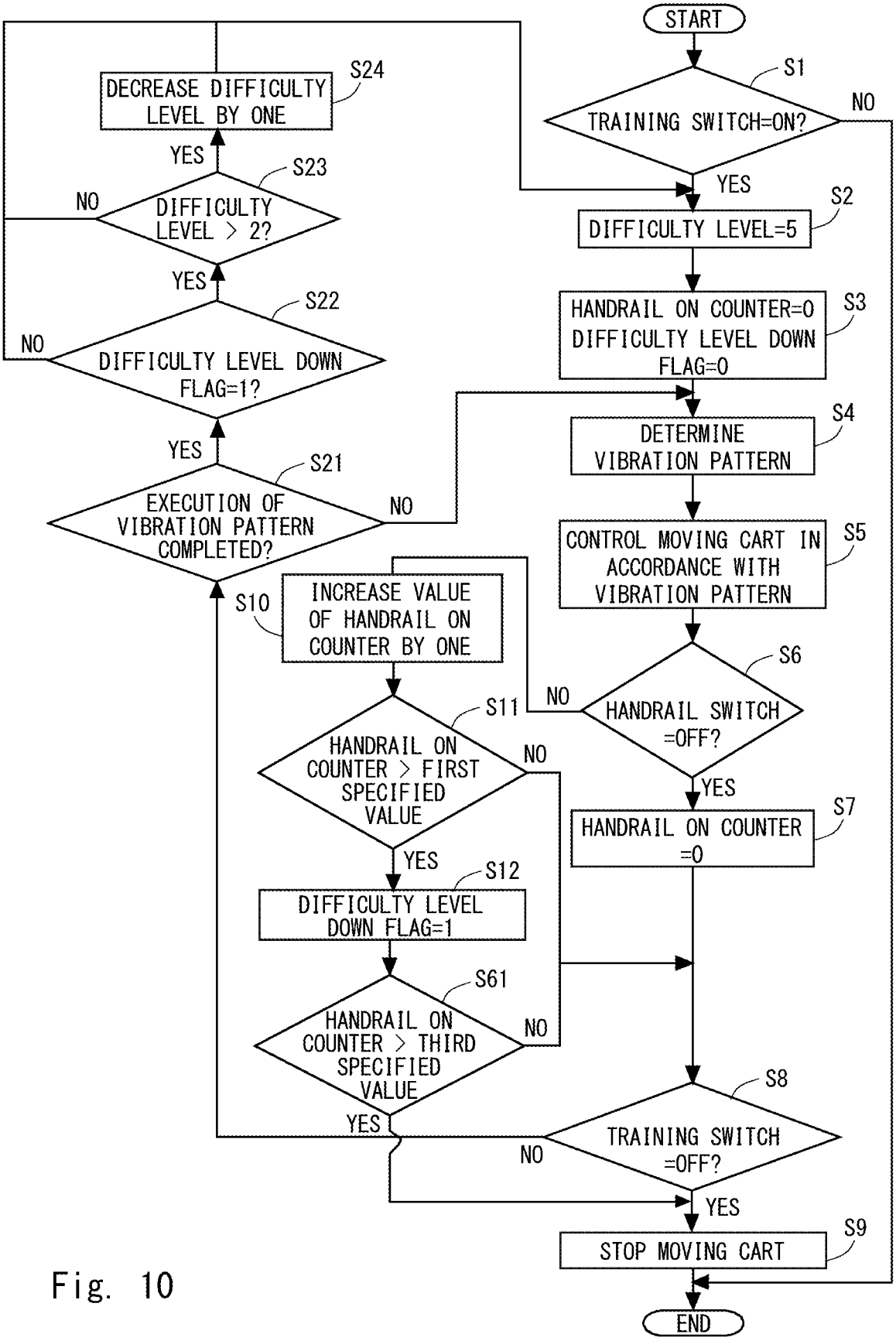
FIG. 10 is a flowchart for describing an operation of a training apparatus according to a fourth embodiment.

In a fourth embodiment, another method of determining the disturbance of the posture of the trainee 900 for changing the difficulty level of the training will be explained. FIG. 10 shows a timing chart for describing a change in the difficulty level of the training in a training apparatus according to the fourth embodiment.

As shown in FIG. 10, in a training apparatus 100 according to the fourth embodiment, processing of Step S61 is added to the flowchart of the operation of the training apparatus 100 according to the first embodiment shown in FIG. 5. Step S61 is processing performed after the processing of Step S12. In Step S61, the difficulty level setting unit 204 determines whether the handrail ON counter is equal to or larger than a third specified value. This third specified value is set to be a value larger than the first specified value. When it is determined in Step S61 that the value of the handrail ON counter is larger than the third specified value (YES in Step S61), the difficulty level setting unit 204 instructs the movement controller 203 to stop the moving cart 110 and to stop the training. On the other hand, when it is determined in Step S61 that the value of the handrail ON counter is equal to or smaller than the third specified value (NO in Step S61), the difficulty level setting unit 204 executes the processing of Step S8 as the next processing.

By providing the processing of Step S61, the training apparatus 100 according to the fourth embodiment detects a state in which the trainee 900 maintains his/her posture while holding the handrail switch 310 or the handrail 162 for a period of time longer than the time specified by the first specified value. It can be determined from the state of the trainee 900 that the difficulty level of the training is much higher than the ability of the trainee 900. Therefore, in the training apparatus 100 according to the fourth embodiment, in a case in which it can be determined that the difficulty level of the training is much higher than the ability of the trainee 900, the training can be forcibly stopped by the processing of Step S61. Accordingly, with the training apparatus 100 according to the fourth embodiment, it is possible to provide training at an appropriate difficulty level for the training apparatus 100 and to increase the safety.

Other Embodiments

In other embodiments, another form of the arrangement of the posture detection sensor 250 sensors that can be used as the posture detection sensor 250 will be explained. In the following description, the respective forms will be described as fifth to eighth embodiments.

Figure 11:
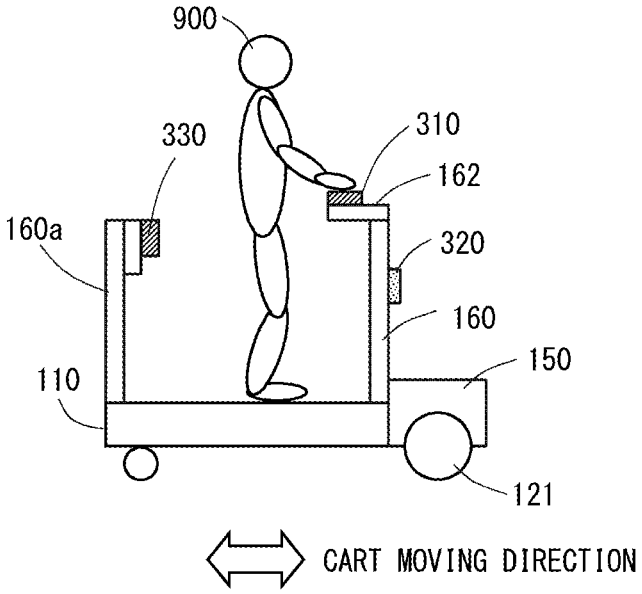
FIG. 11 is a schematic view for describing a function of a training apparatus according to a fifth embodiment.

FIG. 11 shows a schematic view for describing a function of a training apparatus according to a fifth embodiment. In a training apparatus 100 according to the fifth embodiment, handrail switches are provided in a plurality of respective sides of the handrail 162 that is provided to surround the trainee 900. In the training apparatus 100 according to the fifth embodiment shown in FIG. 11, the frame 160 located on the back side of the trainee 900 in a state in which the front of the body of the trainee 900 faces the forward traveling direction of the moving cart 110 is denoted by a frame 160*a*. Then a handrail 162 of the frame 160*a* is provided with a handrail switch 330.

As described above, by providing a plurality of handrail switches in the handrail that surrounds the trainee 900, it becomes possible for the trainee 900 to stably maintain his/her posture when he/she loses his/her posture.

Figure 12:
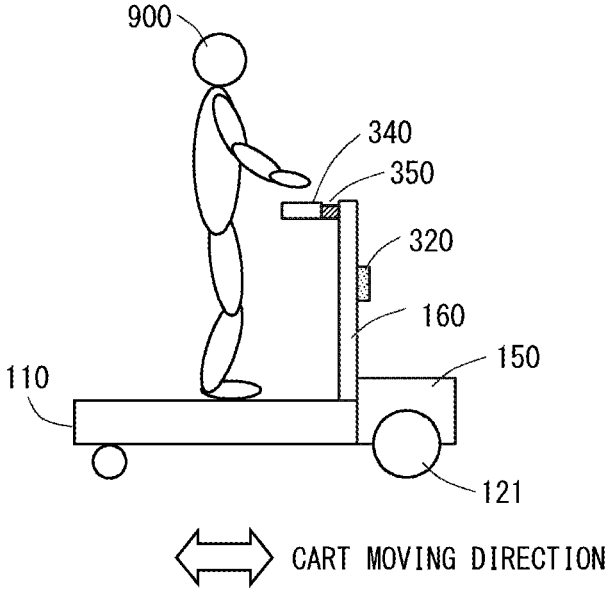
FIG. 12 is a schematic view for describing a function of a training apparatus according to a sixth embodiment.

FIG. 12 shows a schematic view for describing a function of a training apparatus according to a sixth embodiment. In a training apparatus 100 according to the sixth embodiment, a pressure sensor 350 is used as the posture detection sensor 250. As shown in FIG. 12, the pressure sensor 350, which is provided between the frame 160 and a handrail 340, detects the pressure applied to the handrail 340 when the trainee 900 holds the handrail 340.

As described above, by using the pressure sensor 350 as the posture detection sensor 250. regardless of the position of the handrail 340 the trainee 900 holds, the disturbance of the posture of the trainee 900 can be detected.

Figure 13:
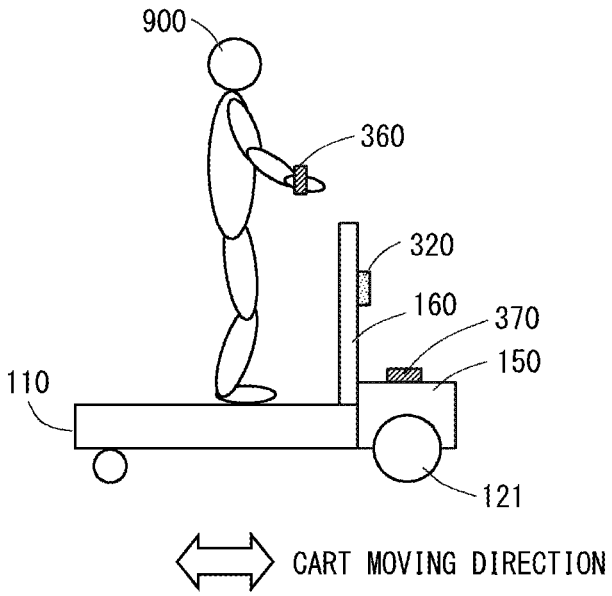
FIG. 13 is a schematic view for describing a function of a training apparatus according to a seventh embodiment.

FIG. 13 shows a schematic view for describing a function of a training apparatus according to a seventh embodiment. In a training apparatus 100 according to the seventh embodiment, a biological sensor 360 is used as the posture detection sensor 250. As shown in FIG. 13, the biological sensor 360 is a wearable terminal attached to a part in the vicinity of the wrist of the trainee 900. Further, the biological sensor 360 communicates with the difficulty level setting unit 204 provided in the control box ISO by radio communication. In FIG. 13, a reception unit 370 is shown as an interface that performs communication between the biological sensor 360 and the difficulty level setting unit 204.

The biological sensor 360 is, for example, a sensor that detects at least one of the heart rate, the respiration rate, the tidal volume, and the perspiration amount in a palm or the like of the trainee 900. When the biological sensor 360 is used, the difficulty level setting unit 204 counts up the value that corresponds to the handrail ON counter (the name is not limited to a "handrail ON counter") when the value detected by the biological sensor 360 exceeds a predetermined threshold.

By using the biological sensor 360 as described above, even when disturbance of the posture of the trainee 900 does not occur, it is possible to detect that an excessive load is applied to the trainee 900 and to provide training at a more appropriate difficulty level for the trainee 900.

Figure 14:
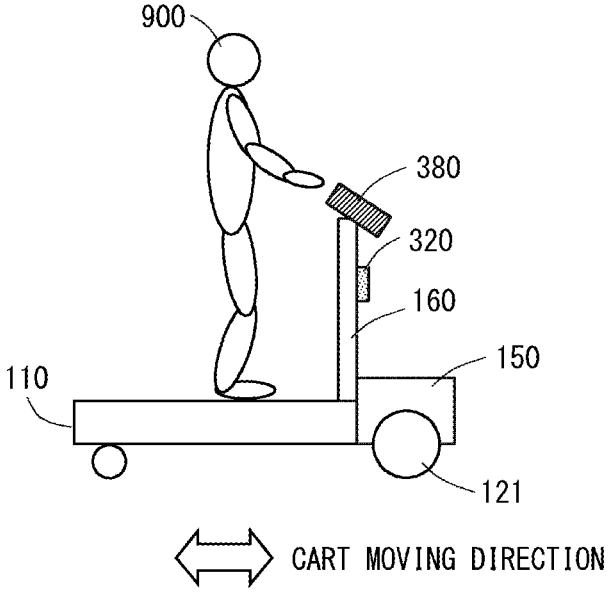
FIG. 14 is a schematic view for describing a function of a training apparatus according to an eighth embodiment.

FIG. 14 shows a schematic view for describing a function of a training apparatus according to an eighth embodiment. In a training apparatus 100 according to the eighth embodiment, a camera 380 is used as the posture detection sensor 250. In the example shown in FIG. 14, the camera 380 is attached to an upper end part of the frame 160, or the handrail 162. The camera 380 captures an image of the trainee 900. The image captured by the camera 380 may be the trainee 900 himself/herself, or may be an image indicating the skeleton or distribution of body temperature of the trainee 900. When the camera 380 is used, image processing is performed in the camera 380 or the difficulty level setting unit 204, whereby a feature image indicating the posture of the trainee 900 is generated, and the disturbance of the posture of the trainee 900 is detected based on the generated feature image.

When the feet of the trainee 900 is caused to swing, the trainee 900 performs operations such as vigorously raising his/her arms while leaning back or vigorously putting his/her arms forward while bending his/her upper body forward in order to balance himself/herself. By using the camera 380, the motions of the upper body and the upper limb of the trainee 900 are detected, and when, for example, the operation speed of the upper limb exceeds a specified value, it is determined that the training at a difficulty level that is above the ability of the trainee 900 is being provided. In this case, the difficulty level of the training can be decreased.

By using the camera 380 as described above, it is possible to determine whether the difficulty level of the training provided for the trainee 900 is appropriate using the reaction made by the trainee 900 who does not hold the handrail.

A (The) program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training apparatus comprising:

a moving cart capable of moving on a moving surface by driving a driving unit;

a movement controller configured to drive the driving unit and to move the moving cart in accordance with a predetermined swing pattern;

a posture detection sensor configured to detect that disturbance of a state of a trainee who is standing on the moving cart has become outside of a predetermined range; and a difficulty level setting unit configured to instruct the movement controller to change the swing pattern and change a difficulty level of the training that moves the moving cart based on results of detecting the state of the trainee regarding which a notification is sent from the posture detection sensor.

2. The balance training apparatus according to claim 1, wherein the posture detection sensor comprises at least one of a handrail switch provided in a handrail attached to the moving cart, a pressure sensor that is provided between the handrail and a strut that supports the handrail, a biological sensor that is attached to a part of the body of the trainee and detects biological information of the trainee, and a camera that is attached to the moving cart and captures an image of the posture of the trainee.

3. The balance training apparatus according to claim 1, wherein the difficulty level setting unit reduces the difficulty level when a duration period of a state during which disturbance of the state of the trainee regarding which a notification is sent from the posture detection sensor has become outside of the predetermined range has exceeded a first specified value.

4. The balance training apparatus according to claim 3, wherein the difficulty level setting unit instructs the movement controller to stop the training when the duration period of a state during which disturbance of the state of the trainee regarding which a notification is sent from the posture detection sensor has become outside of the predetermined range has exceeded a third specified value that is larger than the first specified value.

5. The balance training apparatus according to claim 1, wherein the difficulty level setting unit reduces the difficulty level when an integrated value of a time period of a state during which disturbance of the state of the trainee regarding which a notification is sent from the posture detection sensor has become outside of the predetermined range has exceeded a predetermined rate in a determination threshold period having a predetermined length.

6. The balance training apparatus according to claim 1, wherein the difficulty level setting unit increases the difficulty level when a duration period of a state during which the disturbance of the state of the trainee regarding which a notification is sent from the posture detection sensor is within the predetermined range has become equal to or larger than a difficulty level increase determination period set based on a second specified value.

7. A non-transitory computer readable medium storing a control program of a balance training apparatus in which a trainee standing on a moving cart that moves on a moving surface performs balance training, the control program causing a computer to execute the following steps of:

a movement control step for driving a driving unit that moves the moving cart to move the moving cart in accordance with a predetermined swing pattern;

a posture detection step for detecting that disturbance of the state of the trainee has become outside of a predetermined range; and a difficulty level setting step for changing the swing pattern and changing a difficulty level of the training that moves the moving cart based on results of detecting the state of the trainee regarding which a notification is sent in the posture detection step.

* * * * *